US005333485A

United States Patent [19]

Üblacker

[11] Patent Number: 5,333,485

[45] Date of Patent: Aug. 2, 1994

[54] PROCESS FOR FLATTENING THE END SECTION OF A TUBE

[75] Inventor: Peter Üblacker, Bürmoos, Austria

[73] Assignee: Austria Metall Aktiengesellschaft, Braunau am Inn, Austria

[21] Appl. No.: 22,006

[22] Filed: Feb. 24, 1993

[30] Foreign Application Priority Data

Feb. 24, 1992 [DE] Fed. Rep. of Germany ..... 4205598

[51] Int. Cl.[5] ..... B21D 41/04

[52] U.S. Cl. ..... 72/367; 72/341

[58] Field of Search ..... 72/341, 367; 29/897, 29/897.3

[56] References Cited

U.S. PATENT DOCUMENTS

| | | | |
|---|---|---|---|
| 1,784,966 | 12/1930 | Johnson | 29/175.1 |
| 4,014,201 | 3/1977 | Troutner et al. | 72/367 |
| 4,621,421 | 11/1986 | O'Loughlin | 72/367 |

FOREIGN PATENT DOCUMENTS

| | | | |
|---|---|---|---|
| 385472 | 12/1923 | Fed. Rep. of Germany | 72/367 |
| 107730 | 6/1984 | Japan . | |
| 86036 | 5/1986 | Japan . | |

*Primary Examiner*—Lowell A. Larson

[57] ABSTRACT

Process for flattening the end sections of a tube. The end section is given a preparatory treatment such that two recesses or notches lying opposite one another are made in the tube wall. The tube wall is then pressed together so that the fold lines run through the recesses.

16 Claims, 2 Drawing Sheets

FIG. 1a
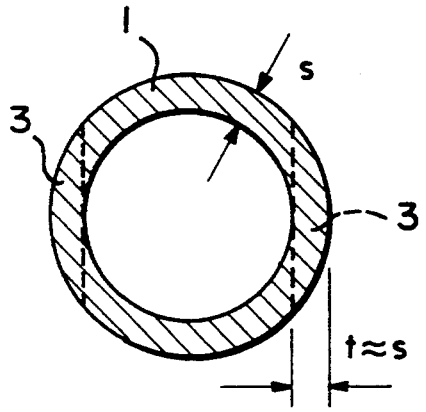
FIG. 1b
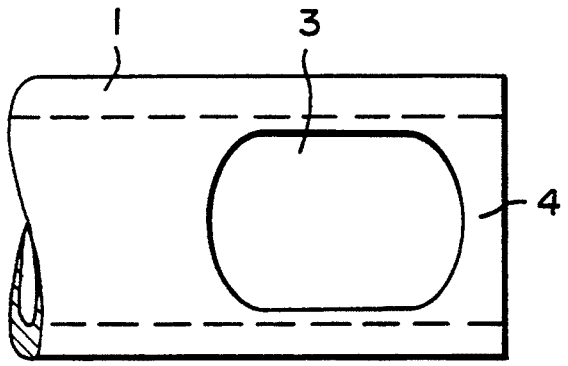
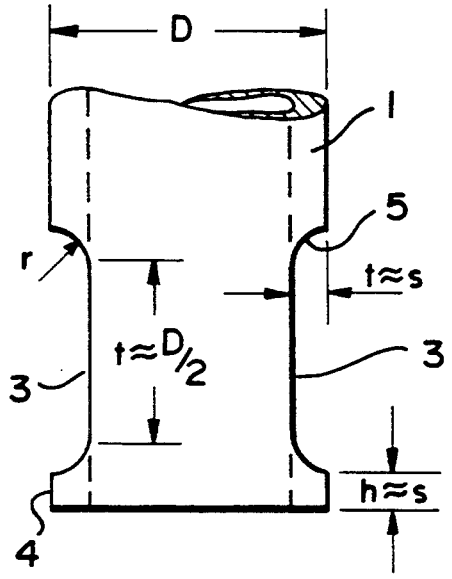
FIG. 1c
FIG. 2a
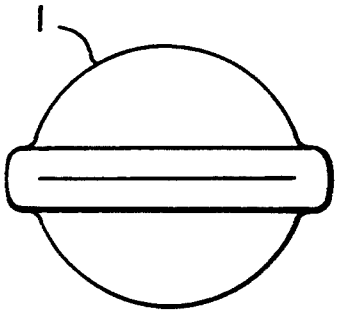
FIG. 2b
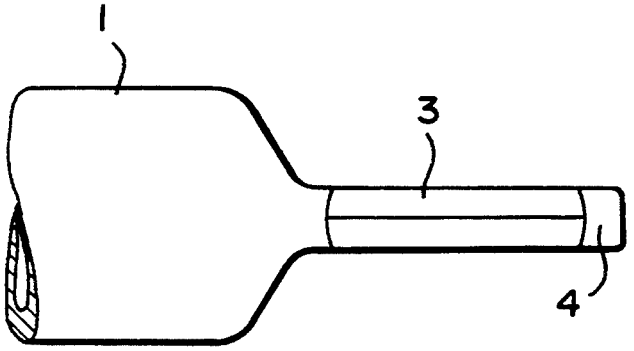

PROCESS FOR FLATTENING THE END SECTION OF A TUBE

BACKGROUND OF THE INVENTION

1. Field of the Invention

The present invention relates to processes for flattening an end section of a tube.

2. Description of Related Art

Processes for making the end sections of tubes flat are used to enable the tubes to be connected in an end-to-end fashion. This connecting can be performed by arranging the flattened ends of two tubes next to one another and then welding them to one another, or by making bores through the flattened tube ends and then screwing the tube ends together with a screw going through these bores.

Supporting frames, scaffolds, braces, etc. made of tubes, in particular metal tubes, can be made from the noted types of connected tubes. In such environments, the mechanical strength of the connection of the tubes to one another, as well as of the tubes to other structural parts of the structure in question, is an essential design feature.

However, in flattening the end section of a tube, in which the tube wall is, usually, pressed together over a certain area at the tube end, problems appear relating to the fact that the greater the wall thickness of the tube, as compared to its diameter, and with increasing strength of the tube material, the greater is the danger that the end section of the tube will tear when the tube wall is flattened. The flattened end section of the tube, then, consists of two flat metal parts with dangerous burrs that can spread further apart from one another.

This problem is serious, in particular, in tubes for frame structures, since the latter consist of very strong and durable materials, and thus, tear very easily when the end sections are pressed together.

Tests have shown, for example, that when flattening the end section of a tube made of a strong aluminum alloy with 60 mm outer diameter and 5 mm wall thickness to form even, flat parts with a size of at least 40×40 which are, later, to be provided with bores for receiving a threaded Joint, the biggest bulges appears, during the flattening of the tube wall, at two opposite points on the tube periphery at a distance of about 35 mm from the face of the tube. Starting at these points, tears form that propagate radially inward and axially in both directions. These tears finally reached even the face of the tube.

The flattened end section of the tube consisted finally of two more or less evenly split parts spread apart from one another. Such tube ends are unsightly and dangerous because of the sharp burrs. Further the danger exists that the existing tears may continue to grow.

SUMMARY OF THE INVENTION

It is, therefore, a primary object of the present invention to provide a process for flattening the end sections of a tube with which the end sections of a tube can be flattened without tearing thereof.

This object is achieved according to a preferred embodiment of the present invention by making two opposite notches or recesses in the tube wall of the end section, and then pressing the tube wall together with a force that is oriented essentially parallel to the tube wall sides in which the notches or recesses are made.

These and further objects, features and advantages of the present invention will become apparent from the following description when taken in connection with the accompanying drawings which show, for purposes of illustration only, a preferred embodiment in accordance with the present invention.

BRIEF DESCRIPTION OF THE DRAWINGS

FIGS. 1*a*–1*c* show a sectional view, a side view and a top view of the end section of a tube after the formation of recesses or notches therein;

FIGS. 2*a* & 2*b* show the end section of a tube flattened according to the process according to the invention in end and side elevational views;

DETAILED DESCRIPTION OF THE PREFERRED EMBODIMENT

Figure 3A:
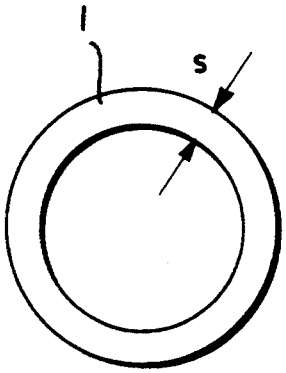
FIGS. 3*a* & 3*b* show the end section of a tube without preparatory treatment in end and side elevational views.
Figure 3B:
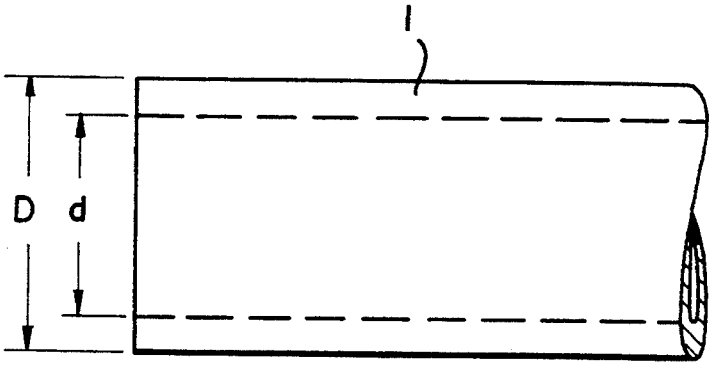
Figure 4A:
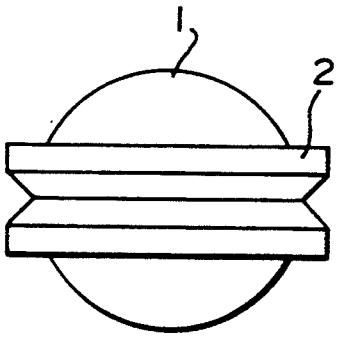
FIG. 4a (PRIOR ART)
FIGS. 4*a* & 4*b* show the end section of a tube flattened according to the usual process in end and side elevational views.
Figure 4B:
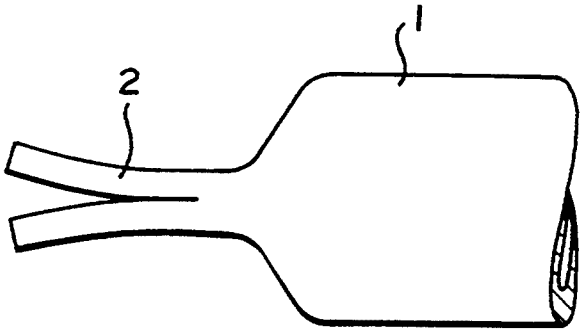
FIG. 4b (PRIOR ART)

As represented in FIGS. 3 and 4, usually the end section of a tube 1 is flattened by having its tube wall is pressed together without any prior treatment. In such a case, the result can often be a flattened tube end as it is represented in FIG. 4, in which the flattened end section consists of two more or less even parts 2 that are torn open along the fold lines of the tube wall and are spread apart from one another.

As represented in FIG. 1, in the process according to the invention, first a preparatory treatment is performed such that two recesses or notches 3 are milled into the end sections of tube 1 which are to be flattened; these recesses or notches 3 lie, essentially, radially opposite one another.

Recesses or notches 3 are preferably made so that, in the lengthwise direction, i.e., in the axial direction, a flange 4 with the cross section of the entire tube remains. That is, the recesses or notches 3 terminate at point at a predetermined distance from the tube end. Depth t of the recesses or notches 3 and length h of unworked flange 4 on the tube end are preferably about equal to the wall thickness of tube 1; but, the desired effect appears already when recesses or notches 3 are of a depth smaller than the wall thickness, i.e., it is not necessary that the recesses or notches 3 create openings through the tube wall even though such is preferred, as shown.

The length l of the recesses or notches 3 depends on the desired length of the flattened end section of the tube, but is at least equal to half outer diameter D of the tube 1.

As it is represented in particular in FIG. 1, edges 5 of the recesses or notches 3 rounded in the direction of the wall thickness of the tube wall, i.e., are radiused so as to create a concave curvature.

When the process according to the invention is applied to a tube with an outer diameter D of 60 mm and a wall thickness s of 5 mm, then recesses are made preferably with a depth t of 5 mm, a width h of flange 4 in the axial direction of 5 mm, a length 1 of 30 mm and a radius of curvature r for edges 5 of 17.5 mm.

After making recesses or notches 3, the end section of tube 1 is flattened, so that the resulting bend or fold lines of the tube wall run through them. In other words, the end section is pressed together with a force oriented essentially parallel to the tube wall sides in which notches 3 are made, and thus, the recesses or notches 3 are made at points of the tube wall in the peripheral direction at which the biggest bulges, and therefore, tears, would appear when the tube wall is flattened.

Since, with the process according to the invention, the notched areas in the end sections of the tube are those areas in which tears would otherwise appear, when the end section is flattened, the formation of tears that could propagate up to the face of the tube is prevented. The flattened tube wall parts are further held together by flange 4 made on the face.

The process according to the invention is suited particularly well for flattening the end sections of a tube made of a strong aluminum alloy, such as, e.g., AlMgSi, AlZnMg or AlMgMl.

The process according to the invention can be applied not only to cylindrical tubes of a circular cross section, but also to cylindrical tubes with noncircular cross sections, for example, where the end sections of the tube have an elongated cross-sectional shape which is narrow at first sides thereof than at second sides thereof as is the case for ovular cross sections and cross sections having two parallel, straight, top and bottom sides connected by semicircular, narrow sides. With such cross sections, the notches are made in the narrow sides.

While we have shown and described various embodiments in accordance with the present invention, it is understood that the same is not limited thereto, but is susceptible of numerous changes and modifications as known to those skilled in the art. Therefore, I do not wish to be limited to the details shown and described herein, and intend to cover all such changes and modifications as are encompassed by the scope of the appended claims.

What is claimed is:

1. Process for flattening the end section of a cylindrical tube, comprising the steps of making two recesses or notches in a hollow cylindrical tube wall of the end section at opposite sides thereof, and then pressing the hollow cylindrical wall together with a force oriented essentially parallel to the sides of the cylindrical wall in which the recesses or notches have been made so as to cause lines along which folding or bending of the tube wall occurs to run through said recesses or notches as the hollow cylindrical wall is flattened.

2. Process according to claim 1, wherein the recesses or notches terminate at a predetermined distance from the end of the tube wall, such that a flange-like part with a cross section matched to that of the entire tube remains at said end.

3. Process according to claim 2, wherein the recesses or notches are made so that the width of the flange-like part is about equal to the thickness of the tube wall in the axial direction of the tube.

4. Process according to claim 3, wherein the recesses or notches are made with a length in the axial direction that is about equal to half of the outer diameter of the tube.

5. Process according to claim 4, wherein the recesses are made with a depth that is about equal to the thickness of the tube wall.

6. Process according to claim 5, wherein the recesses are made by milling.

7. Process according to claim 5, wherein the edges of the recesses are rounded into the tube wall.

8. Process according to claim 7, wherein the end sections of a tube have an elongated cross-sectional shape which is narrow at first sides thereof than at second sides thereof, and the recesses are made in the narrow sides.

9. Process according claim 8, wherein a tube made of an aluminum alloy is used.

10. Process according to claim 1, wherein the recesses or notches are made with a length in the axial direction that is about equal to half of the outer diameter of the tube.

11. Process according to claim 1, wherein the recesses are made with a depth that is about equal to the thickness of the tube wall.

12. Process according to claim 1, wherein the edges of the recesses are rounded into the tube wall.

13. Process according to claim 1, wherein the recesses are made by milling.

14. Process according claim 1, wherein a tube made of an aluminum alloy is used.

15. Process according to claim 1, wherein said aluminum alloy is selected from the group consisting of AlMgSi, AlZnMg and AlMgMl.

16. Process for flattening the end section of a tube, comprising the steps of making two recesses or notches in a tube wall of the end section at opposite sides thereof, and then pressing the tube wall together with a force oriented essentially parallel to the tube wall sides in which the recesses or notches have been made so as to cause lines along which folding or bending of the tube wall occurs to run through said recesses or notches; and wherein the recesses or notches are spaced inwardly a predetermined distance from the end of the tube wall, leaving a part of tube with a continuous cross section matched to that of the entire circumference of the tube at said end.

* * * * *